United States Patent [19]

Hill

[11] Patent Number: 5,014,879

[45] Date of Patent: May 14, 1991

[54] LOCKABLE TUBE ROLLER

[76] Inventor: Robert Hill, 150 Robin Way, Los Gatos, Calif. 95030

[21] Appl. No.: 910,254

[22] Filed: Sep. 19, 1986

Related U.S. Application Data

[63] Continuation of Ser. No. 637,745, Aug. 6, 1984, abandoned.

[51] Int. Cl.[5] ..... B65D 35/32

[52] U.S. Cl. ..... 222/99; 222/214; 242/96

[58] Field of Search ..... 222/97–101, 222/103, 104, 214; 242/96; 132/33 R, 33 A, 33 B, 33 G, 33 E, 39, 40, 41 R, 41 B, 48 R, 48 A, 46 A; 24/346, 487, 490

[56] References Cited

U.S. PATENT DOCUMENTS

| | | | |
|---|---|---|---|
| 610,355 | 9/1898 | Kinne et al. | 222/99 |
| 706,732 | 8/1902 | Ellington | 222/99 |
| 951,132 | 3/1910 | Kinsey | 222/99 |
| 955,530 | 4/1910 | Morrison | 222/99 |
| 1,310,083 | 7/1919 | Huntoon | 222/99 |
| 1,559,565 | 11/1925 | Farnum | 222/99 |
| 1,850,008 | 3/1932 | Gore | 222/105 X |
| 2,252,911 | 8/1941 | Archer | 132/41 B |
| 2,364,596 | 12/1944 | Archer | 132/41 R |
| 2,593,929 | 4/1952 | Solop | 132/41 R |
| 2,808,963 | 10/1957 | Farrow | 222/100 |
| 2,862,647 | 12/1958 | Dietz | 222/214 |
| 2,896,822 | 7/1959 | Songer | 222/99 |
| 2,903,162 | 9/1959 | Regan | 222/99 |
| 3,204,636 | 9/1965 | Kariher et al. | 132/48 R X |
| 3,412,739 | 11/1968 | Thatcher | 132/48 R |
| 3,473,698 | 10/1969 | Ballin | 222/100 |
| 3,628,696 | 12/1972 | Duiker | 222/99 |
| 3,880,328 | 4/1975 | Leeson | 222/100 |

FOREIGN PATENT DOCUMENTS

| | | | |
|---|---|---|---|
| 288098 | 4/1928 | United Kingdom | 222/99 |
| 701423 | 12/1953 | United Kingdom | 222/99 |

*Primary Examiner*—Kevin P. Shaver

*Attorney, Agent, or Firm*—Flehr, Hohbach, Test, Albritton & Herbert

[57] ABSTRACT

A device for winding up collapsible tubes, having open and closed ends, to allow full expression of contents from the open end and to prevent the wound tube from unwinding. The device includes an elongated slot shaped opening in one member or mandrel for receiving the closed end of a tube, such as a toothpaste tube. After the tube has been inserted into that slot and some amount of tube contents has been expressed, a handle, pivotally attached to one end of the member containing the slot, is pivoted to an open position not overlying the slot and substantially normal to the longitudinal axis of the mandrel and is used to wind the tube. After winding, the handle will be pivoted back to its closed position where it is horizontally offset from and overlies at least a part of the mandrel and will rest against the wound layer or layers of tubing therebetween. Because of the cooperative relationship of the handle and the mandrel, the tube is prevented from unwinding.

3 Claims, 4 Drawing Sheets

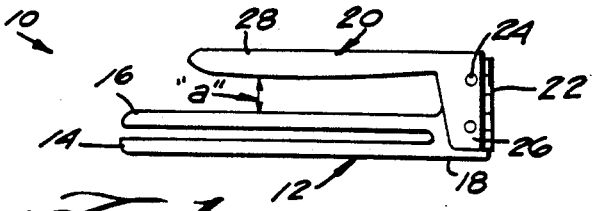
Fig. 1
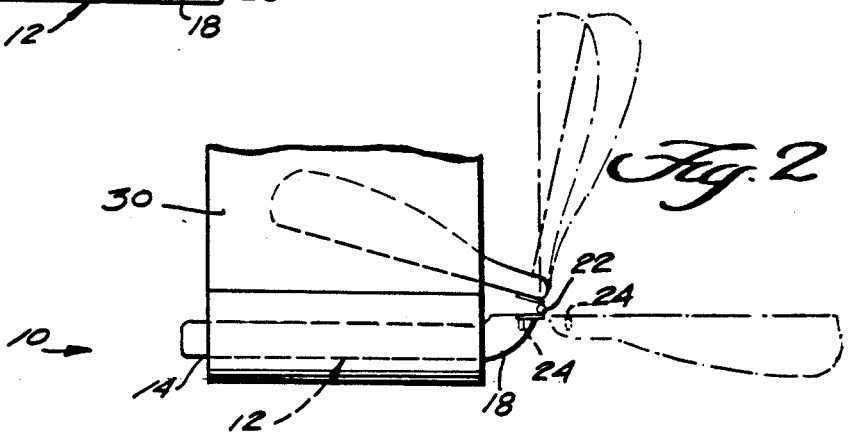
Fig. 2
Fig. 3
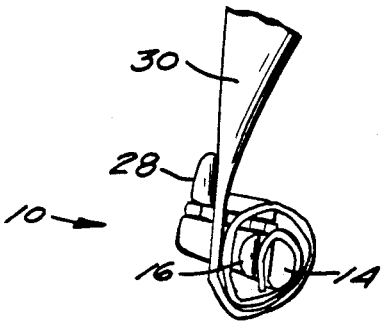
Fig. 4
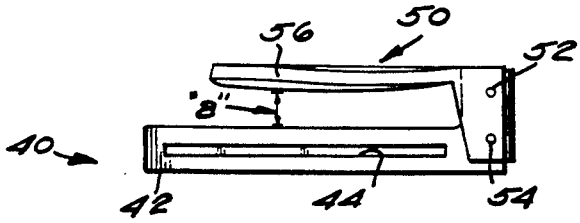
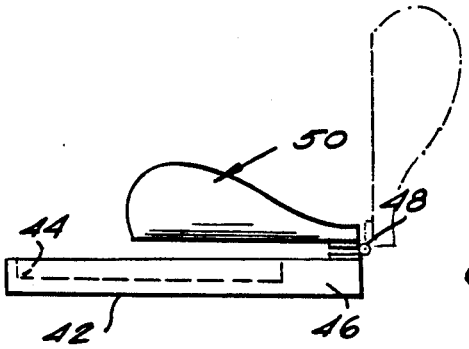
Fig. 5

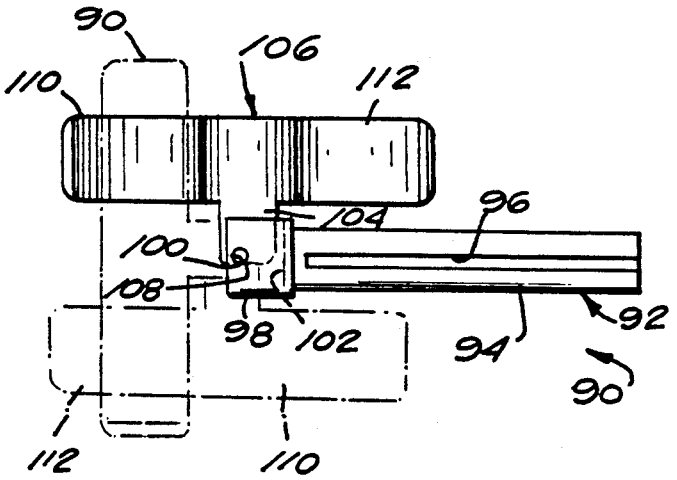
Fig. 9
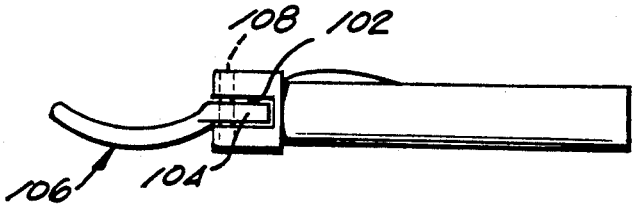
Fig. 10
Fig. 11
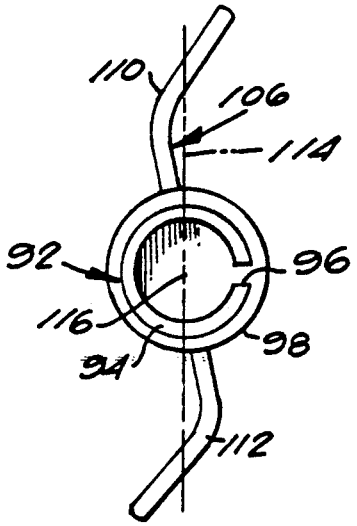

LOCKABLE TUBE ROLLER

This is a continuation of application Ser. No. 637,745, filed Aug. 6, 1984, and now abandoned.

The present invention relates to a portable winding or rolling device for collapsible tubes, specifically for tubes such as those containing toothpaste, which provides a convenient means for maximally emptying the tube contents, and which consists of a mandrel and a turning handle integrally pivoted therewith where said handle also serves to lock the tube in the desired wound position, thus preventing the tube from unwinding as the contents are further expressed.

BACKGROUND OF THE PRESENT INVENTION

Collapsible tubes have generally been difficult to completely compress in order to express all of the contents from the tube. As a result, there have been a number of devices developed in the art to aid in rolling in order to squeeze the contents therefrom in an efficient and smooth manner. These devices have, by and large, been fairly complicated or bulky arrangements and may have included a rigid outer housing in which a winding member can be inserted. The closed end of the tube would be inserted into the winding member and both would then be inserted into the outer housing structure. Often the outer housing was made of porcelain or some solid material so that the tube would be supported by the device. As additional material was needed from the tube, a key like handle rigidly connected to the winding member could be turned. This would pull the tube downwardly into or toward a slot type opening, normally including converging outer flanges or lips. As the tube was forced through that opening, material in the tube would be expressed toward the opposite end. The tube would be wound between the winding member and the inside of the housing so that the amount of tube that could be rolled would be limited by the interior space therebetween.

Exemplary of this type of structure include that disclosed in Farrow, U.S. Pat. No. 2,808,963, Songer, U.S. Pat. No. 2,896,822, Ballin, U.S. Pat. No. 3,473,698 and Leeson, U.S. Pat. No. 3,880,328.

Some tubes have also included integral winding devices such as in Kinne et al, U.S. Pat. No. 610,355, Huntoon, U.S. Pat. No. 1,310,083, Ellington, U.S. Pat. No. 706,732, Morrison, U.S. Pat. No. 955,530, and Farnum, U.S. Pat. No. 1,559,565.

Dietz, U.S. Pat. No. 2,862,647, discloses a locking curler for resilient tubes and comprises a metal sheet folded to form a hollow, tubular member that includes a tube receiving slot. One end is flattened and bent back upon itself to form a finger tab. A separate spring wire locking member is pivotally secured at the point of the bend in the flattened finger tab area and can pivot through an arc from one side of the tubular member to the other. The locking member is constructed from spring wire and includes a pair of arms extending generally parallel to the axis of the tubular portion and are joined together by a rear horizontal portion forming part of the hinge. Additionally, the wire includes two inwardly directed stops which abut the flattened portion. Accordingly, the arms swing through planes generally parallel to and spaced from the axis of the tubular portion.

Regan, U.S. Pat. No. 2,903,162, shows three embodiments of a lockable winding key for use with collapsible wall tubes. Two are similar in construction to two types of hair barretts while the third is comprised of two non-circular wound spring segments joined together by a rod that extends parallel to the axis of the winder and acts as the tube restrainer. The two wound spring segments are shaped to resist rotation relative to the tube coiler. One of the other embodiments comprised a tubular coiling portion and a closed loop retaining wire pivotally connected to one end of the tubular portion and releasably secured at the opposite end when in its closed position. In that closed position, one side of the retaining wire loop will be pressed against the tube's exterior and prevent relative rotation of the tube to the tubular portion. The other embodiment includes a winding bar to which a single retaining bar is pivotally attached at one end and the opposite free end is releasably secured to the other. Thus, when the free end is secured in place, the retaining bar is positioned directly over and is axially aligned with the winding bar.

Duiker, U.S. Pat. No. 3,628,969, discloses a rotatable mandrel over which a tube collapsing roller is positioned by a wire support that flexes to accommodate an increasing radius as the tube is collapsed and which maintains the tube in its wound or rolled condition. The roller remains engaged with the mandrel or tube and the ends of the mandrel include arms or turning lugs at each end which are simultaneously counter-rotated to rotate the mandrel and move the tube relative to the collapsing roller.

In each of the patents cited above, means for rolling the collapsible tube on the mandrel and means for preventing the wound tube from unwinding are provided by separate structures.

SUMMARY OF THE PRESENT INVENTION

The present invention deals with a tube rolling device that is compact, easy to operate, lightweight and effective to prevent unwinding. Moreover, the handle of the device provides a dual function, i.e., provides means for winding and means to prevent unwinding.

The device is comprised of a first member or mandrel around which the tube will be wound about a longitudinal axis of such mandrel. The mandrel is secured or securable to the closed end of the tube to be wound to enable such winding. In one realization of the invention the mandrel is provided with an elongated slot parallel with the long axis of the mandrel with the slot having sufficient dimensions to receive the closed end of the tube to be wound. Pivotally attached to one end of the mandrel preferably by a hinge, is a combined handle and locking lever. This handle is shaped so that when it is in its closed position, it is horizontally offset with respect to a plane extending vertically through the axis of the mandrel. Thus, the handle will also be offset relative to the unwound portion of the tube. When some portion of the tube has been wound on the mandrel, the wound tube will lie within the gap provided by this offset relationship. There is a natural tendency for the wound tube to unwind and this offset relationship allows a transfer of this unwinding pressure, exerted by the tube, to the closed handle which, in turn, prevents unrolling of the tube. The handle is also positionable in an open position, preferably normal to the mandrel axis, so that the then upstanding portion can be gripped to twist the mandrel relative to the tube to wind up the tube wall. Thus, the handle is positionable between an open position where it lies either normal or parallel to the mandrel and a closed position where it overlies at least a substantial portion of the length of the mandrel, but is horizontally offset as explained above. When the locking handle. is in its "closed" position, the lever will facilitate the manual expression of the contents from the tube by preventing the tube from unwinding as material is expressed.

While toothpaste, glue or other similar tubes are being primarily discussed herein, it should be understood that this invention will work with any type of collapsible tube from which the contents is to be expressed. Moreover, it is contemplated that the tube rolling device can be a separate, independent device, or can be provided as an integral part of a tube at its closed end.

Other objects, features, and characteristics of the present invention as well as the methods and operation and functions of the related elements of the structure, and to the combination of parts and economies of manufacture, will become more apparent upon consideration of the following description and the appended claims with reference to the accompanying drawings, all of which form a part of this specification, wherein like reference numerals designate corresponding parts in the various figures.

BRIEF DESCRIPTION OF THE DRAWINGS

FIG. 1 is a top, plan view of a first embodiment of the present invention;

FIG. 2 is a side, elevational view of the tube shown in FIG. 1 together with a tube shown in phantom with the handle being shown in its various positions between open and closed;

FIG. 3 is an end, elevational view of the tube shown in FIG. 2;

FIG. 4 is a top, plan view of a second embodiment of the present invention;

FIG. 5 is a side, elevational view of the embodiment shown in FIG. 4 with the handle shown in dotted line in its winding position;

FIG. 9 is a side, elevational view of still another embodiment of the present invention showing a different type of locking lever arrangement with the handle shown in two closed positions together with an intermediate open, winding position;

FIG. 10 is a top, plan view of the embodiment shown in FIG. 9;

FIG. 11 is a front, elevational view of the embodiment shown in FIGS. 9 and 10.

Figure 6:
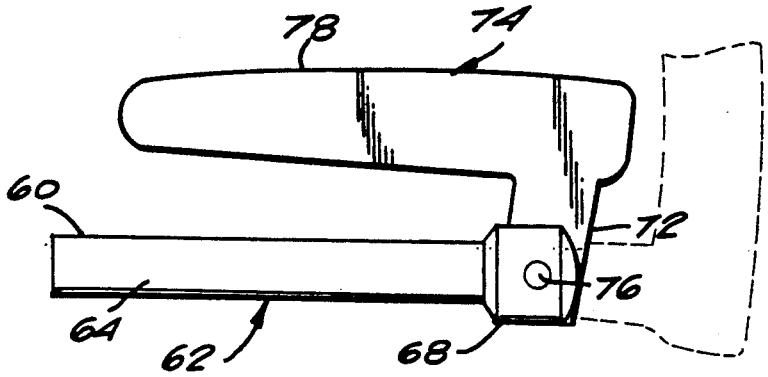
FIG. 6 is a side, elevational view of still another embodiment of the present invention with the handle shown in closed and open positions.

DETAILED DESCRIPTION OF THE PREFERRED EXEMPLARY EMBODIMENTS OF THE PRESENT INVENTION

Turning now to the first embodiment shown in FIGS. 1-3, the present invention is comprised of an opening device generally indicated at 10 including a first member or mandrel 12 itself comprised of two spaced apart legs 14 and 16 joined together by a rear connecting portion 18. A handle 20 is connected to member 12 on connecting portion 18 by means of a hinge 22 or other suitable attaching arrangement that allows handle 20 to pivot. Hinge 22 can be suitably fastened by rivets or screws 24 or some other convenient mechanism that will securely hold the hinge 20 to both connecting portion 18 and the rear portion of handle 20. When the device of the invention is molded out of plastic or the like, the hinge can be a flexible strip or other connection integrally formed with the handle and the mandrel, thus making a one-piece unit.

As shown in FIG. 1, handle 20 includes a rear portion 26, to which hinge 22 is attached, which has a width approximately equal to that of connecting portion 18. The handle structure is then narrowed to define an elongated front portion 28. As can be noted in FIG. 1, when handle 20 is secured in place and in its closed condition front portion 28 is horizontally offset from the space defined between legs 14 and 16 and from the legs themselves. This is also shown in FIG. 3 and that distance is indicated at "a" and can vary from 4–10 mm.

In operation, the closed end of a tube 30 can be positioned within the space between legs 14 and 16, and the handle will be raised to its open position normal to the axis of mandrel 12 parallel to legs 14 and 16. The various open positions for handle 20 are shown in phantom in FIG. 2. It should be noted, however, that the preferred position for handle 20 to wind up the tube is normal to mandrel 12. Using the handle to apply winding force to the mandrel, the tube can be wound around legs 14 and 16. When the desired amount of tubing has been wound thereabout, the tube is wound past or through the space defined between handle 20 and leg 16 when the handle is closed, as shown in FIG. 3. Handle 20 is then moved to its closed position, generally parallel to the long axis of the mandrel. This is shown in both FIGS. 2 and 3. As indicated most clearly in FIG. 3, the pressure of the tube as it attempts to unwind will now be placed directly against the inside surface of handle 20 and until handle 20 is moved out of the way, further movement in that direction will be prevented. Thus, the position of the tube relative to member 12 will be fixed or locked in place.

Turning now to FIGS. 4 and 5, the second embodiment of the device is generally indicated at 40 and is comprised of a first member or mandrel 42 which is a solid piece of material in which a slot, generally indicated at 44, has been cut. While slot 44 as shown extends only a partial way through member 42, it could be cut so that it extends all the way through. Member 42 can either be round or rectangular in cross-section and again slot 44 should be of a length long enough to accept a tube therein. Member 42 includes a rear portion 46 on which is mounted a hinge 48 for connecting handle 50. Again, hinge 48 can be integrally formed as part of a one-piece molded unit, or can be connected to both handle 50 and member 42 by rivets or screws as shown in 52 or some other convenient mechanism. Handle 50 includes an enlarged rear portion 54 which tapers toward a front leg portion 56 which is again offset with respect to a plane extending vertically through slot 44. That distance is also equal to distance "a" as in the first embodiment shown in FIGS. 1-3.

Figure 7:
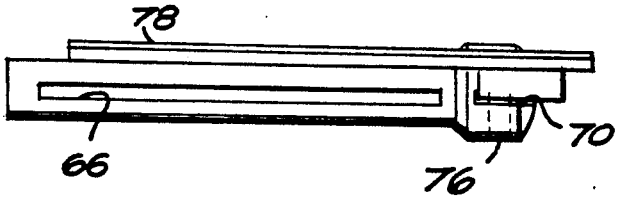
FIG. 7 is a top, plan view of the embodiment shown in FIG. 6.
Figure 8:
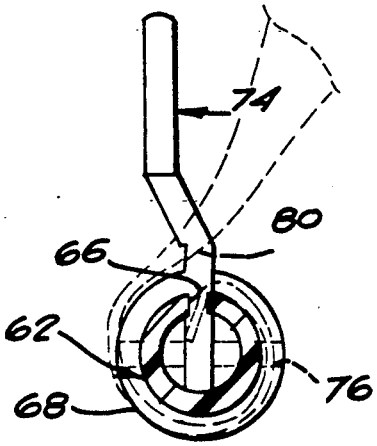
FIG. 8 is an end, elevational view of the embodiment shown in FIG. 6 showing a tube in phantom wound thereon.
Figure 12:
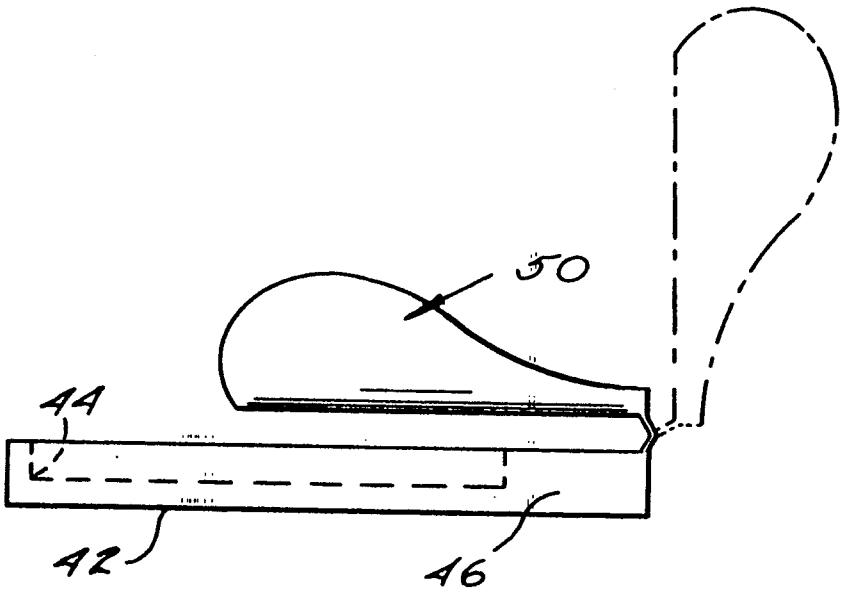
FIG. 12 is a side, elevational view of yet another embodiment of the present invention.

Turning next to FIGS. 6-8, the third embodiment, generally indicated at 60, is comprised of a first member or mandrel, generally indicated at 62, which includes a tube engaging front portion 64 in the form of a hollow cylinder in which a slot 66 has been cut. Cylindrical member 64 extends back to a slightly larger diameter shaped rear portion 68 which is preferably formed as a solid member. Within rear member 68, however, a vertical slot 70 has been cut to receive the depending portion 72 of handle 74. In order to provide the pivoting relationship between member 62 and handle 74, a mounting pin 76 is provided within a bore drilled through the rear portion 68 in a direction normal to slot 70. In addition to the depending portion 72, handle 74 includes an elongated tube engaging front leg 78. As shown in FIG. 8, handle 74 is formed such that the tube engaging leg 78 is offset from depending portion 72. This provides the horizontal offset desired between leg 78 and slot 66. Also, shown in FIG. 8, a portion of tubing 80 has been wound around the first member 62 and a portion lies directly against the front surface of leg 78.

Turning next to FIG. 9, the device, generally indicated at 90, includes a first portion 92 comprised of a cylindrically shaped tube engaging portion 94 in which a slot 96 has been cut. It should be noted that slot 96 differs from slot 66 in FIG. 7 in that slot 66 is not shown as going all the way to the end of the first member but rather stops just before the end of cylinder 64. In FIG. 9, slot 96 does go all the way to the end and permits the closed tube end to be easily inserted or removed. Slot 66 could also be extended to be fully open as is slot 96.

Portion 92 also includes a rear section 98 in which a through bore 100 and a vertical slot 102 have been cut to receive a mounting tab 104 of a combination lock and handle, generally indicated at 106. The mounting of handle 106 is accomplished by a pin 108 in such a manner that handle 106 can pivot through 180° between two closed positions.

As shown in FIG. 9, handle 106 includes two curved wings 110 and 112 which extend outwardly away from the central portion of the handle from which a mounting tab 104 extends at right angles relative to wings 110 and 112. As shown in FIGS. 10 and 11, each one of the wings 110 and 112 will be offset with respect to the cylindrically shaped tube engaging portion 94 when the handle is in its "closed" position, with this being shown best in FIG. 9. Dotted line 114 in FIG. 11 represents a vertical plane extending through axis 116. Thus, after some portion of a tube has been wound upon portion 94 when handle 106 is moved to one of its "closed" positions, the tube will engage either wing 110 or 112 so that this embodiment provides the ability to lock the wound tube in place with handle 106 in either of its two closed positions. That is, either leg 110 can be in a cooperative overlying relationship with cylinder 94 as shown in full line with FIG. 9 or leg 112 can be in a cooperatively overlying relationship with cylinder 94 as shown in phantom in FIG. 9.

As illustrated, it will be noted that in all the embodiments described, a limiting means is provided to prevent the handle from being pivoted inadvertently when it is moved to its closed position, past a position in which it is generally parallel to the mandrel. It also will be appreciated from the above that the device of the instant invention is relatively inexpensive. It is contemplated that it be provided as an integral part of a tube adjacent its closed end, rather than having a slot for removably securing the same to a tube. When it is provided as such a construction, the device of the invention is disposable along with the remainder of the tube after the tube is empty.

Each of the above embodiments is preferably constructed from a rigid material, either metal or, preferably, a plastic or thermoplastic material and can be molded or cast or otherwise formed. In addition, the slots in the various embodiments can be either integrally formed during molding or subsequently cut.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims, which scope is to be accorded the broadest interpretation so as to encompass all such modifications and equivalent structures.

What I claim is:

1. A device for winding up a collapsible tube having an openable end and a closed end to allow full expression of the contents from the closed end toward the openable end and to prevent unwinding of the wound tube; comprising: mandrel means, having an elongated body and a longitudinal axis, for taking up the tube as the mandrel means is rotated about said axis, and a handle having a rigid gripping portion and a mounting portion pivotally secured to said elongated body, said handle being movable at least between a first position where said gripping portion extends in the direction of the axis of and is horizontally offset from the elongated body of said mandrel means so that the wound up portion of the tube lies between said elongated body and said gripping portion and is prevented from unwinding, and a second position where said gripping portion is positioned substantially normal to said axis of said mandrel means so that the gripping portion can be used to wind the tube; said gripping portion including first and second wing members, each extending substantially radially in opposite directions from said mounting portion, and said handle is movable between a first position wherein said first wing member underlies said elongated body and extends generally therealong and in a direction of the axis thereof so as to be horizontally offset from said elongated body; a second position wherein each of said first and second wing members are positioned substantially normal to the axis of said mandrel means, and a third position wherein said second wing member overlies said elongated body and extends generally therealong and in the direction of the axis thereof so as to be horizontally offset from said elongated body.

2. A device as in claim 1, wherein said mounting portion has a length sufficient to space each of said wing members from said mandrel means when said handle is in a closed position.

3. A device as in claim 1, wherein said device is comprised of a plastic material.

* * * * *